United States Patent [19]

Maruyama

[11] Patent Number: 4,555,685

[45] Date of Patent: Nov. 26, 1985

[54] FORMED PERMANENT MAGNET

[75] Inventor: Ryozi Maruyama, Ageo, Japan

[73] Assignee: Dai-Ichi Seiko Co., Ltd., Kawaguchi, Japan

[21] Appl. No.: 675,473

[22] Filed: Nov. 29, 1984

Related U.S. Application Data

[63] Continuation of Ser. No. 446,419, Dec. 2, 1982, abandoned.

[30] Foreign Application Priority Data

Dec. 9, 1981 [JP] Japan ..... 56-196993

[51] Int. Cl.[4] ..... H01F 7/02

[52] U.S. Cl. ..... 335/303; 335/306; 310/168

[58] Field of Search ..... 335/284, 285, 295, 302, 335/303, 305, 306; 252/62.54; 310/168

[56] References Cited

U.S. PATENT DOCUMENTS

| | | | |
|---|---|---|---|
| 3,126,617 | 3/1964 | Blume | 335/302 X |
| 3,184,654 | 5/1965 | Bey | 335/302 X |
| 3,235,302 | 2/1966 | Benson | 335/302 X |
| 3,235,675 | 2/1966 | Blume | 335/302 X |
| 3,250,831 | 5/1966 | Hooper | 335/302 X |
| 3,359,152 | 12/1967 | Blume | 335/302 X |
| 3,407,371 | 10/1968 | Gosma | 335/302 X |
| 3,731,722 | 5/1973 | Carr | 335/285 X |
| 3,821,676 | 6/1974 | Carr | 335/285 |
| 3,969,644 | 7/1976 | Nowak | 335/306 X |
| 4,002,937 | 1/1977 | Anson | 335/303 |

*Primary Examiner*—George Harris

*Attorney, Agent, or Firm*—Cushman, Darby & Cushman

[57] ABSTRACT

A formed permanent magnet which comprises a base made of magnetic material and having gaps with a predetermined width formed between portions thereof serving to form magnetic poles and which is formed by magnetizing those portions serving to form magnetic poles, the formed permanent magnet ensuring high accuracy in the distance between respective magnetic poles.

12 Claims, 10 Drawing Figures

FORMED PERMANENT MAGNET

This is a continuation of application Ser. No. 446,419, filed Dec. 2, 1982, now abandoned.

BACKGROUND OF THE INVENTION (a) Field of the Invention

The present invention relates to a formed permanent magnet to be used with a speed sensor for an automobile and the like.

(b) Description of the Prior Art

For a speed sensor for an automobile, rotation sensor for a motor for a tape recorder, etc., it is required to obtain a large number of output pulses within one rotation. Besides, high accuracy is required for the output pulses, i.e., the amplitude, pulse interval, etc. of the output pulses should be uniform.

Known formed permanent magnet used with this kind of sensors are constructed, for example as shown in FIG. 1 and FIG. 2, by providing multiple magnetic poles, i.e., N poles and S poles, alternately on the peripheral surface of a disk-shaped base. To form the above-mentioned formed permanent magnet, a disk-shaped base of magnetic material is magnetized by using a magnetizer which is composed as shown in FIG. 3. That is, the magnetizer is constructed by forming yokes 2 in a number equal to the number of required magnetic poles and by winding coils 3 onto those yokes 2. The disk-shaped base 1 of magnetic material is magnetized by energizing the coils 3 by an electric current of 1 kA to 100 kA so that the N poles and S poles are formed alternately as shown in the figure.

When the disk-shaped base of magnetic material is magnetized by the above-mentioned known magnetizer, the magnetizing result is subjected to the direct influence of pitch error of magnetizing yokes 2, irregularity in winding of coils 3, etc. and, consequently, dispersion occurs in the distance between magnetic poles of the formed permanent magnet. Therefore, when the formed permanent magnet obtained as above is used in a sensor, dispersion occurs in the output pulses from the sensor and, as a result, the accuracy of the sensor becomes unfavourable.

SUMMARY OF THE INVENTION

It is, therefore, a primary object of the present invention to provide a formed permanent magnet for which the accuracy in the distance between respective magnetic poles thereof is increased by providing gaps at boundaries between respective magnetic poles.

DETAILED DESCRIPTION OF THE PREFERRED EBMODIMENTS

Now, the formed permanent magnet according to the present invention is described in detail below based on preferred embodiments illustrated on the accompanying drawings.

Figure 1:
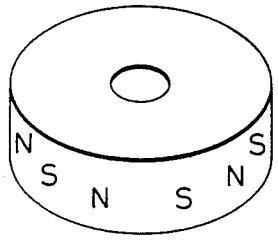
FIG. 1 PRIOR ART
FIGS. 1 and 2 respectively show perspective views of examples of known formed permanent magnets.
Figure 2:
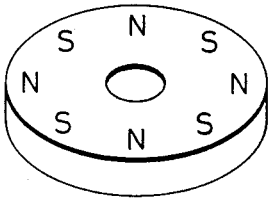
FIG. 2 PRIOR ART
Figure 3:
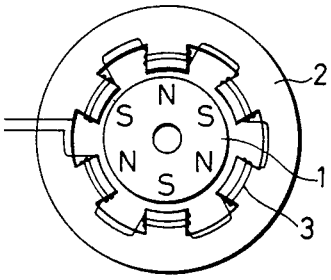
FIG. 3 shows a plan view of a magnetizer to be used for magnetizing the formed permanent magnets shown in FIGS. 1 and 2.
Figure 4:
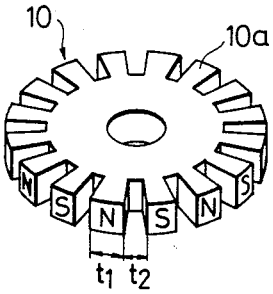
FIGS. 4 through 10 respectively show perspective views of Embodiments 1 through 7 of the formed permanent magnet according to the present invention.

FIG. 4 shows Embodiment 1 of the formed permanent magnet according to the present invention which is arranged to have a gear-like shape. In this embodiment, the gear-shaped base 10 of magnetic material has teeth 10*a* which are formed in a number equal to the number of required magnetic poles. When respective teeth 10*a* of the above-mentioned gear-shaped base 10 are magnetized as N poles and S poles alternately, it is possible to obtain a formed permanent magnet which is substantially equivalent to the known formed permanent magnets shown in FIGS. 1 and 2.

However, the formed permanent magnet constructed as explained in the above has an advantage as described below. That is, when the gear-shaped base 10 is formed so that the width $t_1$ of every booth and width $t_2$ of every gap between respective teeth have accurate values, the distances between respective magnetic poles become accurate even when the magnetizer to be used has pitch error of yokes, irregularity in winding of coils, etc. and, therefore, it is possible to generate pulses with high accuracy.

Figure 5:
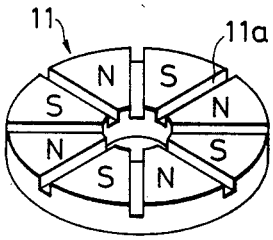

FIG. 5 shows Embodiment 2 of the present invention. In this embodiment, the formed permanent magnet is constructed as follows. That is, a disk-shaped base 11 of magnetic material is arranged to have grooves 11*a* with a certain width which are respectively formed radially at equal distance from each other, and the above-mentioned disk-shaped base 11 is magnetized to form N poles and S poles alternately as shown in FIG. 5. Thus, it is possible to obtain a formed permanent magnet which is substantially equivalent to the known formed permanent magnet shown in FIG. 2 . In the case of Embodiment 2 described in the above, it is also possible to obtain pulses with high accuracy when the disk-shaped base 11 is formed so that the width of respective grooves and distance between respective grooves become accurate.

Figure 6:
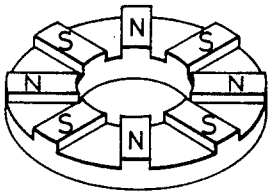
Figure 7:
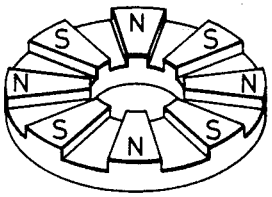

FIGS. 6 and 7 respectively shown Embodiments 3 and 4 of the formed permanent magnet according to the present invention. These embodiments are substantially similar to Embodiment 2 but the disk-shaped bases of Embodiments 3 and 4 are respectively arranged to have grooves of shapes slightly different from the grooves of Embodiment 2 as it will be understood from FIGS. 6 and 7.

Figure 8:
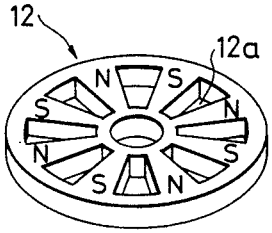

FIG. 8 shows Embodiment 5 of the present invention. In this embodiment, the formed permanent magnet is constructed as described below. That is, a disk-shaped base 12 of magnetic material is arranged to have a plural number of slots or long holes 12*a*, which are respectively formed as through holes in the direction parallel with the axis of the disk-shaped base and, at the same time, as radial slots or long holes, and the above-mentioned disk-shaped base 12 is magnetized to form N poles and S poles alternately as shown in FIG. 8. In case of this embodiment, it is possible to obtain a formed permanent magnet which is substantially equivalent to the known formed permanent magnet shown in FIG. 1 but which has higher accuracy as far as the disk-shaped base 12 is formed accurately.

Figure 9:
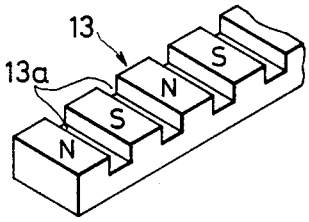

FIG. 9 shows Embodiment 6 of the formed permanent magnet according to the present invention in which the base of magnetic material is formed to have a rectangular parallelepiped shape. That is, the rectangular parallelepiped base 13 having grooves 13*a* is magnetized to form N poles and S poles alternately as shown in the figure.

Figure 10:
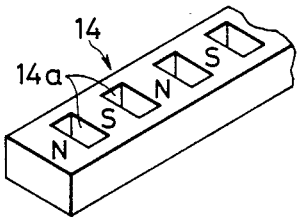

FIG. 10 shows Embodiment 7 of the present invention in which the base of magnetic material is formed to have a rectangular parallellepiped shape in the same way as Embodiment 6. In case of Embodiment 7, the rectangular parallelepiped base 14 is arranged to have through holes 14*a*, and this base is magnetized to form N poles and S poles alternately as shown in FIG. 10.

The formed permanent magnets according to Embodiments 6 and 7 may be used for sensors, in the same way as those of embodiments with gear-shaped or disk-shaped bases, for detection of speed, position, etc. of an object which performs linear movement. When the rectangular parallelepiped bases of magnetic material are manufactured to have high accuracy, these embodiments also enable to obtain favourable formed permanent magnets.

The formed permanent magnet according to the present invention illustrated by respective embodiments described so far may be formed as a synthetic resin magnet which is made by mixing powder of magnetic material into a synthetic resin material and magnetizing the mixture or which is made by mixing powder of magnetic material into a synthetic resin material, giving anisotropy to the mixture and, then, magnetizing the mixture. In this case, it is possible to manufacture the products with high accuracy in dimensions by the same method as forming of synthetic resin products such as injection molding in general.

As described so far, the present invention enables to obtain a formed permanent magnet with extremely high accuracy, as far as the formed permanent magnet is formed to have a shape with high accuracy in dimensions, even when it is subjected to the influence of irregularity in winding of coils, pitch error of yokes, etc. at the time of magnetizing. Besides, when a synthetic resin magnet is used, it is possible to easily obtain the products with high accuracy and, moreover, it is possible to manufacture the products by mass production.

I claim:

1. A formed permanent magnet used as a sensor comprising a base having a plurality of gaps with a predetermined width formed between portions of said gaps serving to form magnetic poles and having a predetermined width, said base being injection molded with a material including a synthetic resin mixed with a magnetic material, said portions between said gaps being magnetized as N poles and S poles, alternately.

2. A formed permanent magnet according to claim 1 wherein said base is magnetized after giving anisotropy to said base.

3. A formed permanent magnet according to claim 1 wherein said base is formed as a disk-type member having said gaps equally spaced in circumferential direction.

4. A formed permanent magnet according to claim 2 wherein said base is formed as a disk-type member having said gaps equally spaced in circumferential direction.

5. A formed permanent magnet according to claim 1 wherein said base is formed as a rectangular parallelepiped member having said gaps formed in the direction at a right angle to the longitudinal direction of said base.

6. A formed permanent magnet according to claim 2 wherein said base is formed as a rectangular parallelepiped member having said gaps formed in the direction at a right angle to the longitudinal direction of said base.

7. A formed permanent magnet according to claim 1 wherein said base is formed as a disk-type member having said gaps extending radially.

8. A formed permanent magnet according to claim 2 wherein said base is formed as a disk-type member having said gaps extending radially.

9. A formed permanent magnet according to claim 1 wherein said base is formed as a disk-type member having through holes which extend radially and, at the same time, which are formed as through holes in axial direction.

10. A formed permanent magnet according to claim 2 wherein said base is formed as a disk-type member having through holes which extend radially and, at the same time, which are formed as through holes in axial direction.

11. A formed permanent magnet according to claim 1 wherein said base is formed as a rectangular parallelepiped member having through holes extending in the direction at a right angle to the longitudinal direction of said base.

12. A formed permanent magnet according to claim 2 wherein said base is formed as a rectangular parallelepiped member having through holes extending in the direction at a right angle to the longitudinal direction of said base.

* * * * *